US010889950B2

(12) United States Patent
Philipsen

(10) Patent No.: US 10,889,950 B2
(45) Date of Patent: Jan. 12, 2021

(54) PORTABLE FLOOD BARRIER SYSTEM AND METHOD OF USE

(71) Applicant: Environment Solutions ApS, Roskilde (DK)

(72) Inventor: Anders Philipsen, Kalundborg (DK)

(73) Assignee: ENVIRONMENT SOLUTIONS APS, Roskilde (DK)

( * ) Notice: Subject to any disclaimer, the term of this patent is extended or adjusted under 35 U.S.C. 154(b) by 0 days.

(21) Appl. No.: 16/081,321

(22) PCT Filed: Mar. 2, 2017

(86) PCT No.: PCT/DK2017/050059
§ 371 (c)(1),
(2) Date: Aug. 30, 2018

(87) PCT Pub. No.: WO2017/148488
PCT Pub. Date: Sep. 8, 2017

(65) Prior Publication Data

US 2019/0024337 A1 Jan. 24, 2019

(30) Foreign Application Priority Data

Mar. 3, 2016 (DK) ..... 2016 70128

(51) Int. Cl.
*E02B 3/10* (2006.01)

(52) U.S. Cl.
CPC ..... *E02B 3/108* (2013.01)

(58) Field of Classification Search
CPC ..... E02B 3/108
See application file for complete search history.

(56) References Cited

U.S. PATENT DOCUMENTS 3,213,628 A * 10/1965 Serota ..... E02B 3/108 405/111
3,374,635 A * 3/1968 Crandall ..... E02B 3/127 405/18
4,362,433 A * 12/1982 Wagner ..... E01F 13/02 405/107
4,981,392 A 1/1991 Taylor
5,669,732 A * 9/1997 Truitt ..... E02B 3/108 405/18
6,641,329 B1 * 11/2003 Clement ..... E02B 3/108 405/115
7,762,742 B1 7/2010 Smith
(Continued)

FOREIGN PATENT DOCUMENTS

CA 2 265 010 A1 9/2000
FR 2 862 322 A1 5/2005
WO 01/61113 A1 8/2001

OTHER PUBLICATIONS

International Search Report and Written Opinion, Appl. No. PCT/DK2017/050059 dated May 19, 2017.
(Continued)

*Primary Examiner* — Tara Mayo-Pinnock
(74) *Attorney, Agent, or Firm* — Winston & Strawn LLP

(57) ABSTRACT

A flood protection system and a method of using such a system. The system includes at least one elongated flexible tube arranged for being filled with and containing a fluid, wherein the at least one flexible tube comprises a number of positioning elements.

19 Claims, 7 Drawing Sheets

(56) References Cited

U.S. PATENT DOCUMENTS

| | | | | |
|---|---|---|---|---|
| 2002/0081153 | A1* | 6/2002 | Genzel | E02B 3/108 405/114 |
| 2003/0118407 | A1* | 6/2003 | Gertz | E02B 3/108 405/115 |
| 2007/0237586 | A1* | 10/2007 | Prestininzi | E02B 3/108 405/115 |
| 2014/0050527 | A1* | 2/2014 | Kelsey | E02B 3/12 405/17 |
| 2015/0308064 | A1 | 10/2015 | Doolaege | |

OTHER PUBLICATIONS

International Preliminary Report on Patentability, Appl. No. PCT/DK2017/050059 dated Jun. 4, 2018.

* cited by examiner

PORTABLE FLOOD BARRIER SYSTEM AND METHOD OF USE

This application is a 371 filing of International Patent Application PCT/DK2017/050059 filed Mar. 2, 2017, which claims the benefit of Danish patent application no. PA 2016 70128 filed Mar. 3, 2016.

BACKGROUND

The invention relates to a portable flood barrier system and a method of using said system.

Flooding, caused by heavy rain, storms or melted snow, is a problem causing great economical damage and sometimes personal injury. For the purpose of flood control various types of barricades are built.

Permanent flood protection devices such as levies are well known. However, it is often necessary to create a temporary, emergency barrier to flooding. Historically, the emergency barrier of choice has been the sandbag. However, sandbags have a number of drawbacks. They are extremely labour intensive and time consuming to fill and transport to the site where they are to be used. Moreover, suitable fill material may not always be available in sufficient quantity. Still further, when the bags are no longer needed, a way must be found to dispose of and/or remove the fill material, another time-consuming and labour intensive activity and one that will require the presence of a suitable dumping area for the fill material.

Therefore, water finable flood-tube barriers are increasingly used as a quick and efficient flood protection solution. The mainly cylindrical tubes made of a flexible material can e.g. be connected to traditional fire hoses and, when filled with water, used at sites threatened by flood.

Such a system is e.g. known from U.S. Pat. No. 4,981,392 which describes a water inflatable structural system for constructing temporary dikes and related structures. Said system comprising two identical elongated flattened tubes joined together by a flexible web alongside each other. The tubes can be inflated with water. Several modules may be stacked in an interlocking structure of any desired height without the use of fastening elements.

Other similar systems are also known in the art, but a general problem with these portable flood barriers according to prior art is their lack of resistance against lateral pressure from the flooded area, which may lead to lateral movement of the flood barrier and the subsequent breaking through of water.

A further problem is that the tubes typically are lightweight and since the conventional system have to be placed in the extended position before being filed with water, the light tubes are exposed to the wind, making it both difficult and challenging to deploy the tubes correctly during hard weather conditions.

A further problem, particularly on soft or permeable ground, is water-flow from the flooded area underneath the barrier.

Thus, there remains a need for a flood protection system and method wherein the system can be more easily, quickly and securely positioned where needed.

SUMMARY OF THE INVENTION

Accordingly, it is a first aspect of the present invention, to provide a flood protection system arranged for being easily deployed, even in extreme weather conditions.

It is a second aspect of the present invention to provide a flood protections system which can form barriers of variable length and height, and wherein the system can be shaped depending on the intended use.

It is a third aspect of the present invention to provide a flood protection system. Which can be used in different locations and on all terrains.

It is a fourth aspect of the present invention to provide a flood protect system which can be relatively easily removed and stored when no longer needed.

It is a fifth aspect the present invention to provide a method of deploying a flood protection system, easily, quickly and securely, in all weather conditions.

The novel and unique features whereby these and further aspects are achieved according to the invention is the fact that the flood protection system comprises

- at least one elongated flexible tube arranged for being filled with a liquid and containing said liquid,
- and wherein the at least one flexible tube comprises a number of position means arranged for ensuring that the at least one flexible tube is placed in a desired position.

The system according to the invention comprises at least one elongated flexible tube arranged for being filled with a liquid and thereby containing said liquid in the flexible tube, thereby providing a barrier in an area e.g. threatened by flooding.

In order to ensure that the at least one respective flexible tube is placed at the correct and desired position, the system according to the invention comprises a number of position means, arranged for placing the flood protection system in a desired position.

The position means is used for ensuring that the at least one flexible tube is placed in desired posit e.g. by mechanically connecting position means placed in different positions on one or more flexible tube(s), and forcing the flexible tube(s) to obtain and remain in a desired position.

This can e.g. be relevant if one or more specific buildings are to be protected from flooding, if the system are to turn around objects or obstacles in the terrain, if the system is to be used for diverting or blocking chemical spills in a specific area, if the uncoiling of the elongated flexible tubes are to be decelerated and/or if the system is intended for providing a protected area, in which e.g. a sea-section is to be protected from high waves etc.

The desired position may thus be any position relevant for moving around obstacles or protecting/damming a specific object, and the flexible tube(s) may accordingly be forced into a curved form, e.g. a sinuous form using the position means. It is accordingly preferred that the desired position is not a substantially straight form of the at least one flexible tube, however it will be understood that a part of the flexible tube might be placed in a straight position while a different part is not.

Alternatively or in addition, the position means may be used for maintaining the elongated flexible tube in a completely or partly rolled up condition. This is first of all an advantage during transport and/or storage, but may also be used to decelerate and/or stop the uncoiling of the flexible tube during deployment at the desired location. Holding the flexible tube in a coiled-up position and releasing the tube gradually will ensure that the elongated flexible tube can be uncoiled in a controlled and secure manner, such that the tube can be placed at the correct and desired location. As the tubes normally are long and heavy, they will be difficult to displace and/or relocate when they are in the uncoiled condition, thus decelerating the uncoiling of said tube using the position means, provide a very simple and effective way of controlling the deployment of the tubes.

The position means can in a preferred embodiment further be arranged for anchoring the flexible tubes to the underlying terrain/ground, thereby ensuring that the at least one flexible tube is capable of resisting the high pressure provided by the flooded area. Thus, in contrast with the liquid-filled tube systems known in the art, in which stability of system is only provided by its weight when the system is filed with water, the system according to the present invention is anchored to the ground by the position means ensuring that the system is capable of withstanding the horizontal pressure of water, accordingly reducing the risk of lateral movement of the at least one flexible tube during use and consequently breaking through of water.

Anchoring the at least one flexible tube to the ground will also ensure that the deployment of said tube can be faster and more efficient than hitherto known, even in hard weather conditions, since the tubes can be anchored to the ground, when deployed and before being filled with water, thereby effectively preventing the at least one tube from being dislocated by e.g. the wind.

Accordingly, the system according to the invention may be deployed quickly and easily irrespectively of the terrain/ground and the weather condition, and it can be ensured that the system is both deployed and remains in the desired position.

When the system according to the invention comprises more that one flexible tube, said position means can also be used to mechanically connect two or more adjacent flexible tubes, both when said tubes are placed side-by-side and when said tubes are stacked atop one another. In both situations, the position means will ensure that the tubes are securely kept in place, providing a stabile structure of several flexible tubes. In this way the position means ensure that several flexible tubes can be mechanically fastened to each other, both laterally and vertically, providing an effective barrier against flooding. The position means is also arranged for allowing the user to prolong the length, to extend the width and/or to increase the height of the system according to the invention, either during deployment or at a later stage (e.g. 2-3 days after deployment) if required.

The position means can in a preferred embodiment be a loop, an eyelet, a snap hook, a snap fit, a key-lock arrangement, a hook-and-loop fastener, and the like. Said position means can in principal have any form, shape and design, as long as they are capable of ensuring that the at least one flexible tube is placed, anchored and/or secured in the desired position.

The position means can be attached to the flexible tube by any conventional means, and the position means can e.g. be an integral part of said tube or be attached to the tube by any other means, e.g. by welding, the only requirement being that they are securely attached to the flexible tubes.

It is preferred that the position means is arranged for working without the use of additional means, this is e.g. the situation were the position means can be directly connected e.g. using snap fits or the like, thereby ensuring that the at least one flexible tube easily can be placed in the desired position. Such direct connections can also be used when e.g. two flexible tubes placed side-by-side are to be connected to each other via the position means.

However, in some situations the position means are used in combination with a fastening means. Said fastening means is preferably arranged for connecting at least two position means, e.g. placed in opposite ends of a flexible tube or on adjacent tubes, and forcing the flexible tube to obtain and remain in a desired position.

In this respect the position means can be one or more ropes, twines, cables, chains, etc. which effectively can be used to mechanically connect the respective position means of the relevant flexible tubes.

The position means can also be used for anchoring the tube to the ground. As an example can be mentioned, that when the position means is in the form of a loop, eyelet or the like, an fastening means in the form of a stake and/or pole can be placed in the opening of the loops/eyelet, and wherein said stake/pole when driven into the ground will anchor the tube to the terrain in a simple and effective manner. Said way of anchoring the tube to the ground, corresponds in principal to the way a tent is anchored to the ground using loops/eyelets and tent poles.

Similar, when the position means on one flexible tube is used to be connected to one or more position means on one or more adjacent flexible tube, the fasting means can be rope, twine, cable, chain, etc. which effectively can be used to mechanically connect the respective position means of the relevant flexible tubes.

Thus, using the position means on the flexible tubes, ensures that the tubes can form barriers of any length, any height, any width/breadth, on all terrains, and that the tubes easily can obtain any position/shape in order to e.g. move around obstacles during deployment.

The number, placements and design of said position means depends on the intended use, and each flexible tube can in principal comprise several different position means, each having their own specific function, i.e. one set of position means can be used for obtained the desired position of the flexible tube(s), one set of position means can be used for anchoring the tube(s) to the ground, one set of positions means is used for connecting tubes placed side-by-side, etc. It is however preferred that the position means are of the same type, and is arranged for all intended uses.

The position means are preferably placed in rows on the outer surface of the at least one flexible tube and in substantially the complete length of the at least one flexible tube. For instance, two rows of position means can in a preferred embodiment be placed on opposite sides of the flexible tube, and four rows can be placed at circumferential regular intervals, etc.

Each position means is preferably placed at regular intervals in said row(s), as this ensures that there will always be relevant position means available for any desired purpose. However, in a different embodiment the position means are placed in specific locations on the flexible tube.

In a preferred embodiment, the system according to the invention comprises at least two, and preferably a number of flexible tubes which can be quickly joined end-to-end by means of at least one coupling unit. Said coupling unit(s) is/are preferably placed at one or both ends of the flexible tube, such that the number of flexible tubes can be interconnected (linked together) thereby forming a flood protection system of virtually any length.

A multiplicity flexible tubes connected end-to-end may be arranged in e.g. a straight line and/or a curved line in order to provide a barrier in the area of interest. It is further preferred that the tubes can be stacked atop one another forming barriers of variable heights and shapes, thereby providing a flood protecting system which is flexible, durable and effective.

The coupling unit can be any kind of unit capable of interconnecting the flexible tubes, and can accordingly be made of both rigid and flexible materials. It is in this respect preferred that the coupling units also establish a liquid flow communication between the interconnected tubes, as this will ensure that the tubes can be filed with liquid from a single central origin.

In a preferred embodiment, each flexible tube comprises one coupling unit, placed near or at a first end of the flexible tube. The opposite, second end, of said flexible tube is preferable adapted for an easy attachment to a coupling unit on a first end of an adjacent flexible tube, thereby providing a simple and effective way of connecting the tubes to each other end-to-end.

Both the first and second end of the flexible tube can be connected to the respective coupling unit(s) via any conventional means, e.g. by using at manacle rings, or O-rings, or via customized means, e.g. by using snap fits, and depending on the material of the flexible tubes and the coupling unit, other attachment methods, such welding, are also contemplated within the scope of the present invention. The only requirement being that the flexible tubes are securely attached/connected to the coupling unit, in a way that the respective parts are not unintentionally detached from each other during operation, such that liquid unintentionally exit the flexible tubes at the attachment point.

When a barrier of several flexible tubes are considered to be sufficiently long, the tube can be closed, either by using a flexible tube having a termination unit instead of a coupling unit, i.e. a unit, which closes the tube and ensures that the liquid is contained inside the flexible tube. However, in a preferred embodiment the coupling unit is arranged for interchangeable either establishing a liquid flow communication between interconnected flexible tubes, or for closing the flexible tubes. This can e.g. be obtained by ensuring that e.g. a lid part can be sealing placed in an opening which would otherwise provide the liquid flow communication between interconnected tubes, thereby effectively closing the coupling unit and turning said coupling unit into a termination unit.

Even though it is preferred that the system comprises a coupling unit (or a termination unit), the at least one flexible tube could also be closed at one or both endings from the beginning, e.g. by welding the flexible tube together, or by having said tube connected to one or more termination unit(s).

It is further preferred that the coupling unit is also arranged for introducing and removing liquid, such as water into the at least one flexible tube, e.g. using an external pumping system. The liquid to be used need not be potable, and is preferably pumped from the body of liquid, e.g. water that is threatening to create the flood condition.

Said coupling unit preferably also comprises a valve, e.g. a pneumatic valve, for both introducing and removing air or gas present in the flexible tube. Said air/gas can e.g. be introduced in the flexible tubes in order allow said tube to be inflated prior to adding liquid, and must accordingly also be removed in order to prevent any overpressure when liquid is added.

Even though the flexible tubes can be filled to any degree, it is preferred that at least 95% of the tubes inner volume is filled with liquid. The same valve which allow removal of air from the flexible tube, can also be used for preventing overpressure when filling the tubes with liquid, however a different valve can also be provided.

One preferred coupling unit is e.g. known from DK201200570 and reference is made to said application for further details in respect of said coupling unit. Other kinds of coupling and terminations units are also contemplated within the scope of the present application, but such systems are known in the art and will not be discussed in further details in this application.

The shape and dimensions of the flexible tube(s) is preferably such that after said tube(s) has been filled with liquid, the final liquid-filled structure will form a barrier to protect buildings, resort properties and any other structures prior to the onset of a flood. However, in a preferred embodiment each flexible tube preferably has a length of between 5 and 300 m, even more preferably between 50 and 100 m, and an outer diameter between 40 and 240 cm, preferably between 60 and 150 cm and most preferred between 80 and 125 cm.

The flexible tubes can be fabricated from any desired flexible material which is waterproof, i.e. liquid tight. Preferred flexible materials are for example polypropylene and polyethylene, polyvinylidene difluoride or modified polytetrafluoro-ethylene (mPTFE). However, inlet pipes made completely or partly of other flexible materials such silicone films are also contemplated within the scope of the present invention. The material of the flexible tube is preferably chosen in dependence of the intended use, i.e. if the system are to be used for damming a chemical spill, then the material should be resistant to said spill.

The at least one flexible tube, or at least a part thereof, are preferably covered with a burlap fabric or other appropriate sheet material to facilitate the tubes being stacked atop one another without or with only minimal relative sliding movement, adding in preventing lateral movement during flooding.

In order to provide a high flexibility and a high strength, the flexible tube(s) could in a preferred embodiment comprise more than one layer, wherein each layer is made of the same or different kinds of material. For instance, if the flexible tube comprises two concentrically arranged layers, providing an inner and outer tube, the inner tube could be made of a material being impermeable for liquids (liquid tight), e.g. polypropylene, and the outer tube could be made of a higher strength flexible material such as fiber reinforced material or the like, enabling the overall flexible tube to have both liquid proof characteristics (inner tube/layer) and high mechanical strength (outer tube/layer). In a preferred embodiment the diameter of the inner tube is larger than the diameter of the outer tube, such that when liquid is filled in the inner tube, said inner tube will expand outwards until the diameter of the outer tube is met, providing a highly stable structure.

It is preferred that the at least one flexible tube does not comprise any joints which could weaken the mechanically integrity of the flexible tube.

The thickness of the material is preferably selected in order to ensure that the required flexibility of the tube is provided and at the same time, that the material is thick enough to withstand the high pressure which the tubes will be subjected to during use. Accordingly, a preferred thickness can be different for the outer and inner layer of a tube. For instance the thickness walls of the outer reinforced layer can be in the range around 150-300 μm, preferably between 180 and 250 μm and even more preferred around 200 μm and the inner water-proof layer can be in the range around 50-300 μm, preferably between 100-200 μm, and even more preferred around 175 μm. The person skilled in the art will however understand, that the thickness could be higher or lower depending on the used material.

In some situations, it will not be possible to anchor the system according to the invention to the ground. In order to ensure that the system also can be securely held in place in such areas, e.g. parking areas and the like, the system according to the invention can comprise one or more weight-addition units preferably disposed inside the flexible tube. Said weight-addition units can preferably be one or more weights (e.g. of sand or metal) placed at intervals in pockets in the flexible tube, e.g. the outer layer and/or one or more weight-tube(s) arranged for being filled with at material having a higher weight than the liquid used for filing the flexible tubes. In one example, the weight-tube is made of the same material as the flexible tube, e.g. the inner layer, and can be filled with cement or sand, providing a high degree of stability and weight to the system.

The present application also relates to a method of deploying the flood protection system according to the invention.

Said method comprises providing a flood protection system according to the invention, deploying the at least one flexible tube simultaneously with filling said flexible tube with either liquid and/or gas, such as air.

The flood protection system is preferably stored, transported and deployed in an empty condition. Accordingly the system is not filled with liquid until the system has been deployed in the area in which the systems flood protection benefits are required.

As mentioned earlier the at least one flexible tube can be deployed in the unfolded elongated position and anchored to the ground using the position means. Once in position, the tube is filled with liquid, optionally said tube it is first filled with air, or with a combination of air and liquid. However, depending on the weather conditions it might still be difficult to ensure that the lightweight flexible tubes remain in the optimal position, until the flexible tube is filled with water to a degree where the tube(s) has obtained a weight which can keep them more securely in place.

Thus, according to the method of the present invention, the at least one flexible tube is deployed simultaneously with filling said flexible tube with liquid, optionally the flexible tube is filled with air and liquid simultaneously, or the flexible tube is first filled with air and then liquid, while removing the air from the tube. This will not only ensure that when the flexible tube is deployed it will simultaneously gain sufficient weight to withstand the weather conditions. It is however preferred that the method further comprises anchoring the at least one flexible tube to the underlying terrain/ground during the deployment, thereby ensuring that the tube cannot be displaced from the desired location.

In order to ensure that the flexible tubes are deployed in the desired position, the position means may be used to maintain the flexible tube in a rolled up position, and then gradually releasing the tube during deployment. In this way the uncoiling of the flexible tube can be decelerate and/or stopped during deployment, such that the tube easily can be placed as desired e.g. around any obstacles etc.

Maintaining the flexible tube in a partly coiled-up position will ensure that the elongated flexible tube can be uncoiled in a controlled and secure manner, such that the tube can be placed at the correct and desired position. As the tubes normally are long and heavy, they will be difficult to displace and/or relocate when they are in the uncoiled condition, and impossible after the tubes has been filed with liquid. Thus decelerating the uncoiling of said tube using the position means will provide a very simple and effective way of controlling the deployment of the tubes.

The flexible tube can in one embodiment be deployed manually, but it is preferred that the flexible tube is provided in a rolled up/coiled condition e.g. on a reel, such that the tube can be unrolled in a simple and easy manner, e.g. using a tube wagon wherein the reel, about which the flexible tube is coiled, is free to rotate about a vertical axis. That is, the flexible tube may be coiled about the reel for storage, transport, etc., and may be uncoiled from said reel when it is deployed. Such reels are well known in the art and will not be discussed in further details in this application.

The system according to the invention can accordingly be used to create temporary dykes, protect critical infrastructure, divert river flow, keep roads open and protect essential utilities among a host of other applications. The rapid deployment system is both labour and energy efficient as well as environmentally friendly when compared to e.g. sandbags.

The system according to the invention can be deployed on all types of ground, in principal in unlimited lengths, widths and heights, and they may be anchored to the ground, shaped e.g. according to the landscape and attached to each other, using the position means.

These temporary engineered, interlocked, and mechanically connected, flexible tubes are then drained of water which flows back into the body of liquid when the flooding subsides. The result is a reusable system that protects property without the need of sandbags. When the flooding recede, the respective tubes can be quickly drained, detached from each other, rolled up and reused again and again, thereby providing a environmentally friendly system.

BRIEF DESCRIPTION OF THE DRAWINGS

The invention will be explained in greater detail below, describing only exemplary embodiments of the flood protection system according to the invention, in which.

DETAILED DESCRIPTION OF THE INVENTION

The invention will be described below with the assumption that the system according to the invention is used in an area threatened by flood, and the flexible tube comprises two layers. However this assumption is not to be construed as limiting, and the system can just as easily comprise only a single or a number of layers and be used for different purposes.

Figure 1:
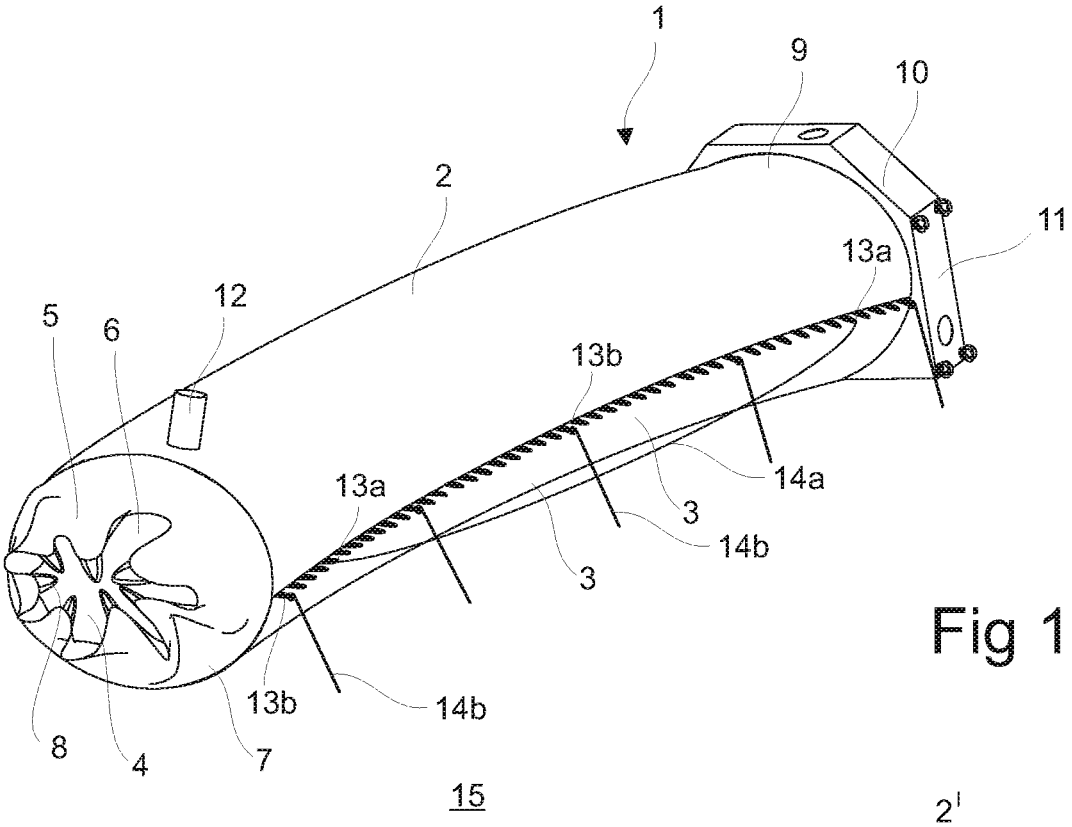
FIG. 1 shows a first embodiment of a system according to the invention, in which a flexible tube is both deployed in a curved position and anchored to the ground using the position means.

FIG. 1 shows a schematic view of a first and very simple embodiment of a system 1 according to the invention. Said system comprises a flexible tube 2 provided with a number of position means 3. Even though it is preferred that the tube is significantly longer than the diameter of the tube, a relatively short tube has been shown in the drawings for the sake of overview.

The flexible tube comprises two concentrically arranged layers 4,5 defining an inner tube 4, preferably made of a material being impermeable for liquids and an outer tube 5, preferably made of a fiber reinforced material. Use of two (or more) separate layers/tubes enables the overall flexible tube to have both liquid proof characteristics (inner tube/layer) and high mechanical strength (outer tube/layer).

In the embodiment shown in FIG. 1, the first end 6 of the inner tube 4 is effectively closed e.g. by welding (not shown), and the first end 7 of the outer tube 5 is wrapped around the inner tube 4, by tightening the first end of the outer tube using the loops 8 provided at the first end 7 of the outer tube, and e.g. a cable (not shown) placed in said loops.

At the opposite, second end 9 of the tube 2, is provided a coupling unit 10, which in the embodiment shown is in the form of a termination unit 11, i.e. said unit will effectively close the tube 2 at said second end, keeping the liquid inside. However, in a very simple embodiment, the second end 9 of the flexible tube could be closed in a similar manner as the first end 6,7, and water could be added to the flexible tube via a one-way valve (not shown) provided in an appropriate location of the tube.

The coupling unit 10 or in this embodiment the termination unit 11, is preferably arranged for introducing and removing liquid, such as water into the at least one flexible tube 2. Addition of liquid from an external source to a desired location, is well known in the art and are accordingly neither described in details, nor shown in the drawings, however, in short, a hose is both placed at the external liquid source, e.g. the water that is threatening to create the flood condition, and connected to the coupling unit, after which liquid is pumped to the flexible tube 2 e.g. using an external pump.

In the embodiment shown, in which the flexible tube comprises two layers, it can be preferred to first introduce air into the flexible tube to ensure that folds etc. in the inner tube are removed before liquid are introduced, and it is accordingly also preferred that the coupling unit 10 and/or termination unit 11 are arranged for introducing air into said tube.

Air present in the flexible tube when liquid is added to the flexible tube, can then be disposed from said tube via an outlet 12. Said outlet can in one embodiment also be used when liquid/water are to be drained from the flexible tubes.

In the embodiment shown the position means 3 are placed in a row, at regular intervals, in substantially the complete length of the flexible tube, as this ensures that there will always be relevant position means 3 available, ensuring that the flexible tube can be anchored to the ground independently of any obstacle, e.g. a stone, that makes the ground inaccessible at certain positions.

The position means 3 are in the form of an loop/eyelet 13 which together with a fastening means 14 are used for both positioning the flexible tube in a slightly curved form and for anchoring the tube to the ground. Accordingly, loops 13*a* are connected via a fastening means 14*a*, in the form of a rope, providing a curved form when tightened, allowing the tube to go around an obstacle (not shown), and fastening means 14*b*, in the form of a stake and/or pole, are used for anchoring the flexible tube 2 to the underlying terrain/ground 15, via loops 13*b*, thereby ensuring that the flexible tube 2 is not only capable of resisting the high pressure provided by the flooded area, but will also be less exposed to wind, accordingly reducing the risk of lateral movement both during deployment and use.

Figure 2:
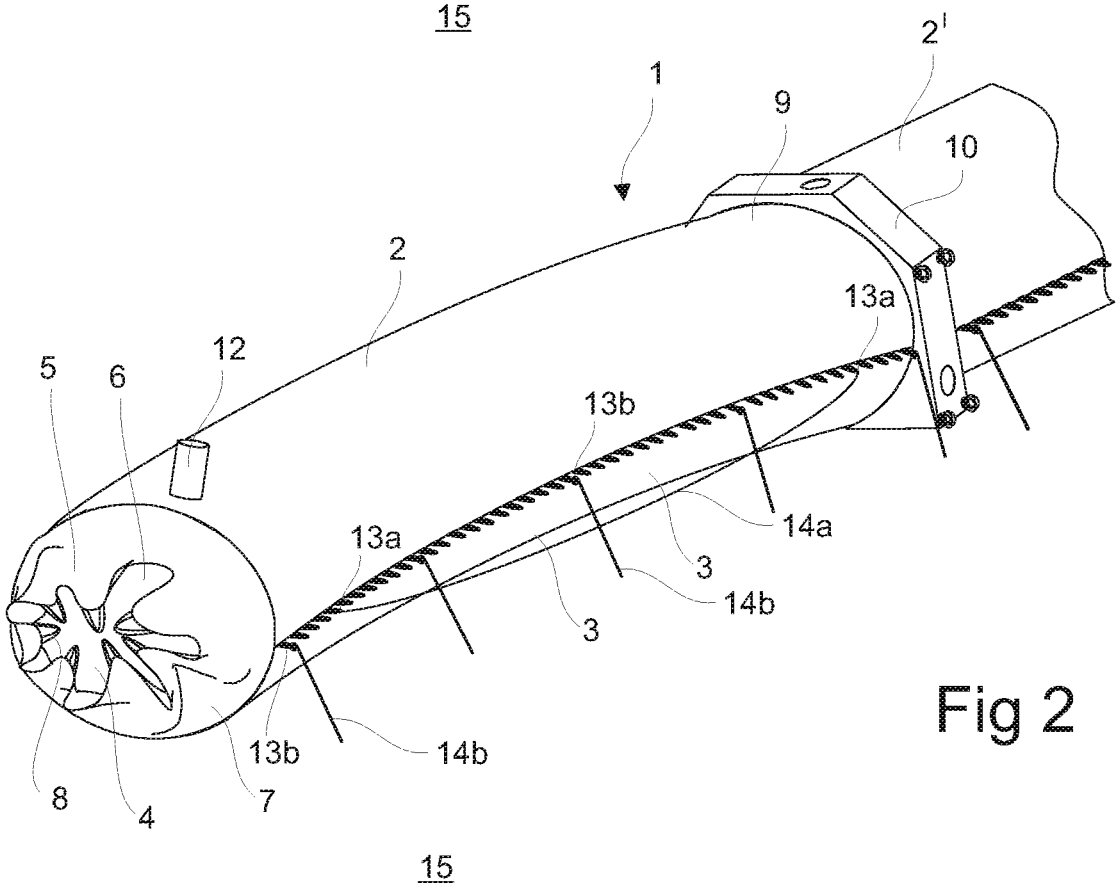
FIG. 2 shows a modification of the first embodiment of FIG. 1, in which two flexible tube are interconnected using a coupling device.

In FIG. 2 which corresponds to the embodiment of FIG. 1 with the modification that the termination unit has been replaced with a coupling unit 10 interconnecting a second flexible tube 2' end-to-end with the first flexible tube 2. In this way it is possible to form a flood protection system of virtually any length, simply by connecting further flexible tubes to the free coupling unit.

Figure 3:
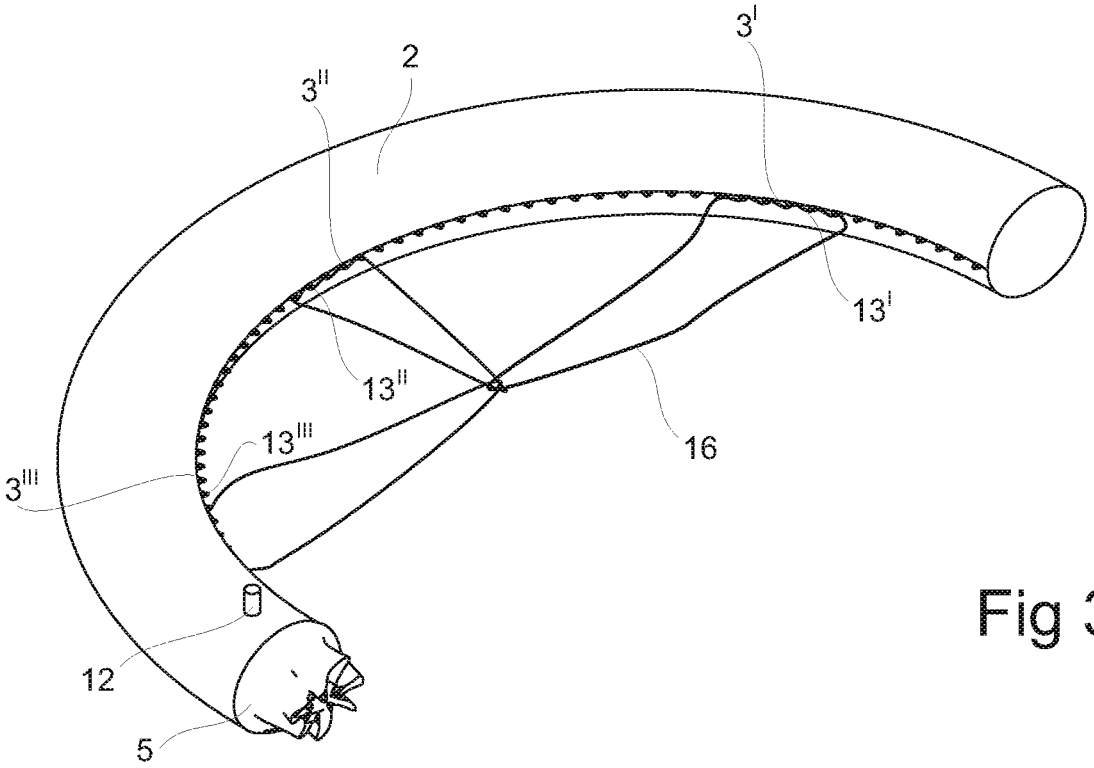
FIG. 3 shows the embodiment of FIG. 1, deployed in an U-form using a first set of position means.

The embodiment shown in FIG. 3 is the same embodiment as the one shown in FIG. 1 without showing the termination unit 11, and wherein several position means are used for placing the flexible tube in a desired curved position. Several loops 3', 3" and 3'" placed in different locations on the flexible tube 2, are mechanically connected by threading a rope 16 (fastening means) through the loops 13', 13", 13'" and forcing the flexible tube 2 into a desired curved position by tightening the rope 16.

Figure 4:
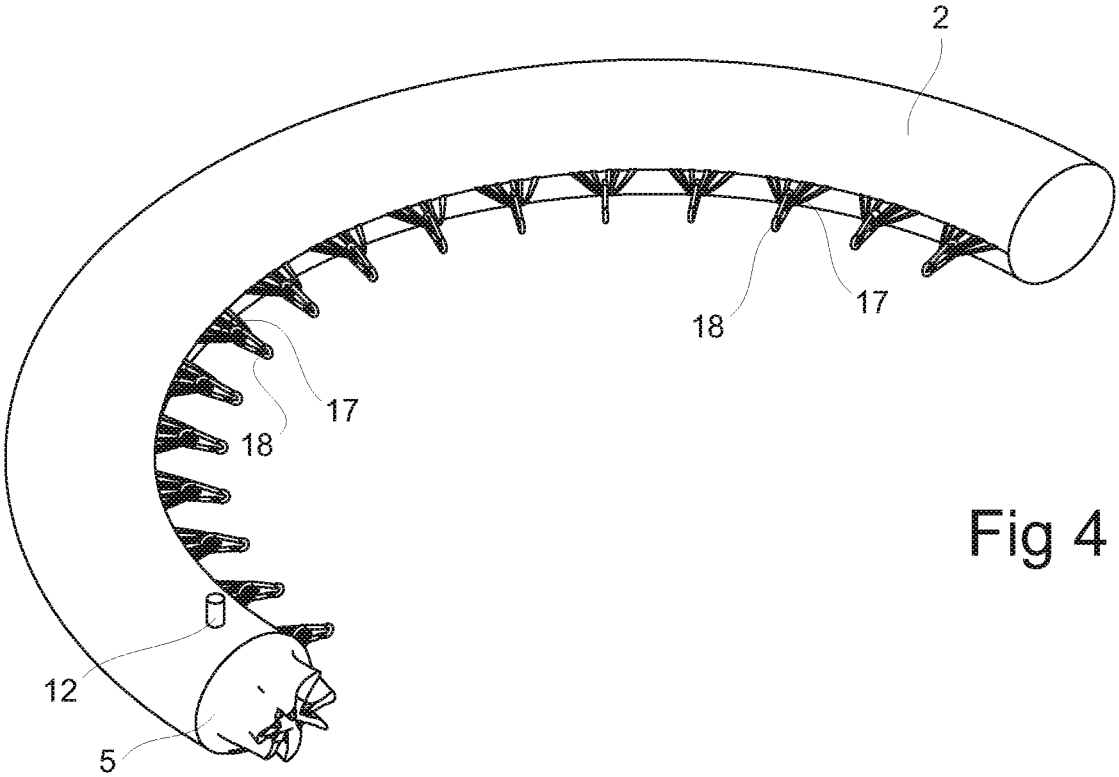
FIG. 4 shows a second embodiment of the system according to the invention, deployed in an U-form using a second set of position means.

FIG. 4 shows how a second set of position means 3, also can be used to form an U-form. In this embodiment each position means 3 comprises three overlapping loops 17 connected by snap ring which either can be anchored to the ground or can be connected using a rope or similar fastening means. The use of several overlapping loops, ensures that even if one loop should be damaged or break, the integrity of the system will remain.

In FIGS. 3 and 4 the flexible tube obtained a U-shape, however the flexible tube could just as easily have obtained an S-shape, or any other desired shape, simply by connecting position means 3 on the same or adjacent flexible tubes as described above. This is especially relevant if the system are to turn around objects or obstacles in the terrain, and/or if the system is to be used for diverting or blocking chemical spills in a specific area.

Figure 5A:
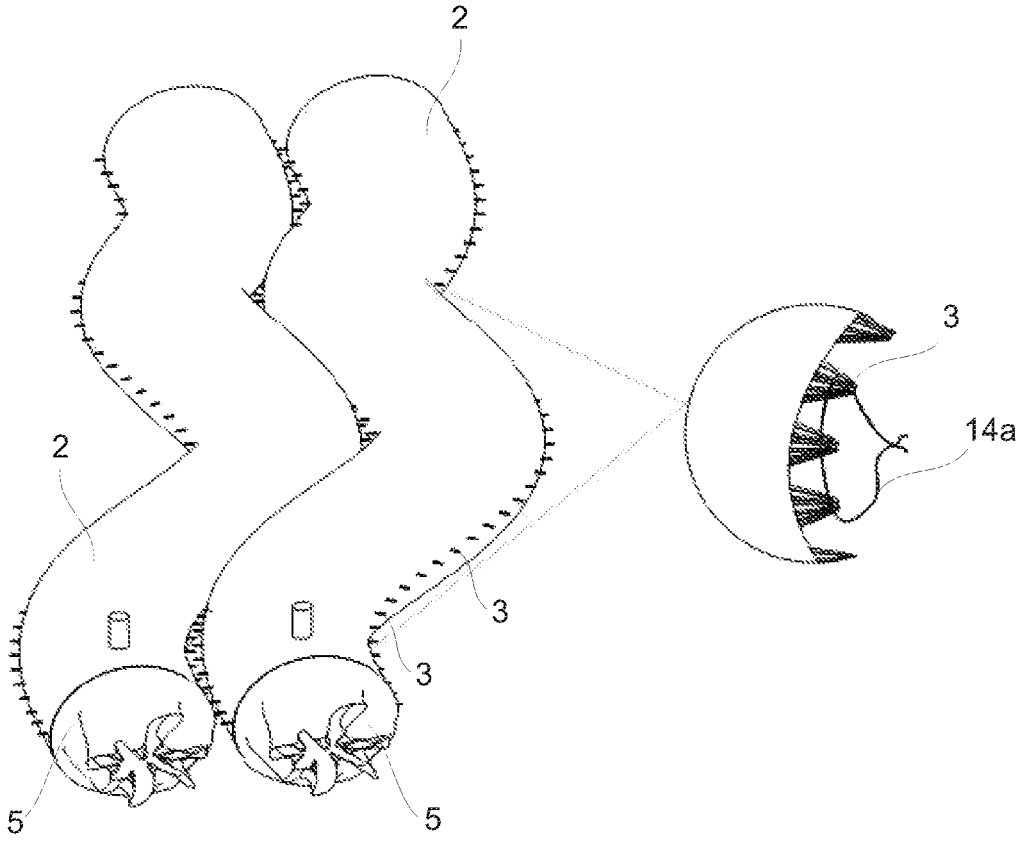
FIG. 5*a* shows a system according to the invention comprising two flexible tubes, and wherein the system is deployed to an S-form.

FIG. 5*a* shows that when the system according to the invention comprises more that one flexible tube 2, said position means 3 can also be used both for ensuring that the flexible tubes are placed in the desired position, here an S-shaped form, and to connect two adjacent flexible tubes 2 placed side-by-side. In order to obtain said S-shaped form, three position means 3 on the same tube are connected and tightened by using a rope 14*a*, whereby the desired form is obtained by fastening said rope.

Figure 5B:
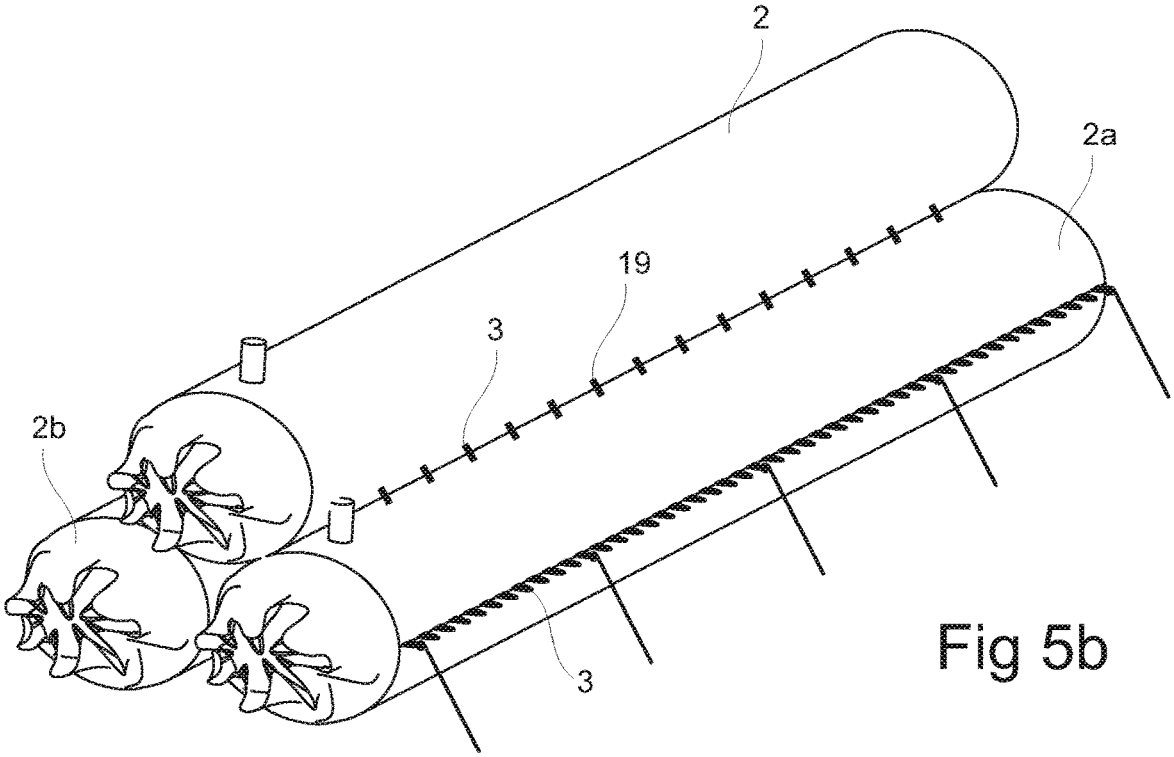
FIG. 5*b* shows a system according to the invention comprising three flexible tubes of the kind shown in FIG. 1.

FIG. 5*b* shows that when the system according to the invention comprises more that one flexible tube 2, said position means 3 can also be used to connect said adjacent flexible tubes 2, both when said tubes are placed side-by-side and when said tubes are stacked atop one another. In this way the position means ensures that several flexible tubes can be fastened to each other, both laterally and vertically. For instance, the two bottom tubes 2*a*,2*b* are anchored to the ground in a similar way as described for FIG. 1. Whereas the upper tube 2*c* is connected to the bottom tubes 2*a*,2*b* using position means 3, which in the embodiment shown are specific snap-fittings 19, i.e. they can be clicked together. Even though the tubes are shown as being deployed in a substantially straight position, it is understood that at least some of the fastening means on either the same or adjacent tube(s) are connected in order to obtained the desired position.

A multiplicity of connected flexible tubes may be arrayed in any desired position, e.g. in a curved, S-formed or round form in order to provide a barrier in the area of interest, using the respective positions means 3 in order to obtain the desired position/form. In the embodiments shown in FIGS. 1-5, the position means is placed at regular intervals, in a single row and in substantially the complete length of the flexible tube. However several rows of position means is also contemplated within the scope of protection, e.g. one row for connecting position means with each others in order to obtain the desired position, one or two row(s) for anchoring the flexible tube to the ground, and one, two, three, etc. rows for connecting adjacent flexible tubes with each other. The position means does however not need to be placed in a row or at regular intervals, they could also be placed at predetermined desired positions on the flexible tube.

The flood protection system 1 is preferably stored, transported and deployed in an empty condition. Accordingly, the system is not filled with liquid until the system has been deployed in the area in which the systems flood protection benefits are required.

The flexible tube 2 can in one embodiment be deployed in the unfolded elongated position and anchored to the ground using the position means 3, and once in position, the tube 2 can be filled with liquid. However, in a preferred embodiment the flexible tube 2 is deployed simultaneously with filling said flexible tube with liquid. This will not only ensure that when the flexible tube 2 is deployed it will simultaneously gain sufficient weight to withstand forces acting upon said tube, e.g. due to hard weather conditions.

Figure 6A:
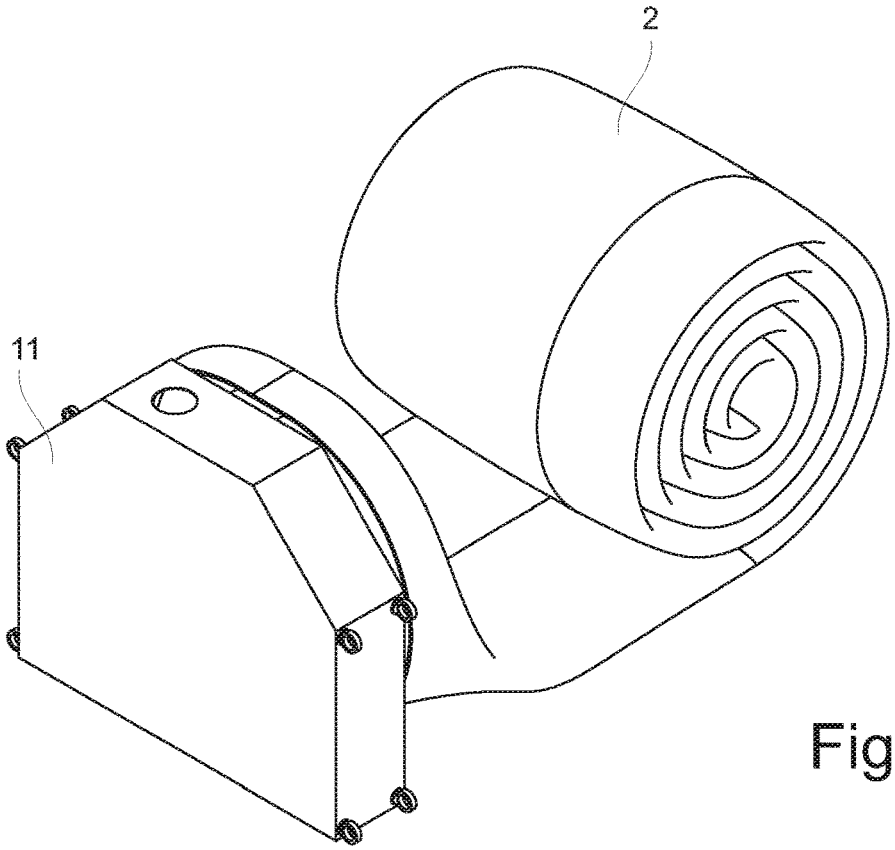
FIG. 6*a* shows the flexible tube of a system according to the invention provided in a rolled up/coiled condition during transport and/or storage.

FIG. 6*a* shows how the flexible tube 2 of a system according to the invention is provided in a rolled up/coiled condition. This means that the tube can be unrolled in a simple and easy manner, when the liquid is added to the tube e.g. via the termination unit 11 as shown in FIG. 7, where a section X of the tube has been unrolled and filed with water.

Figure 6B:
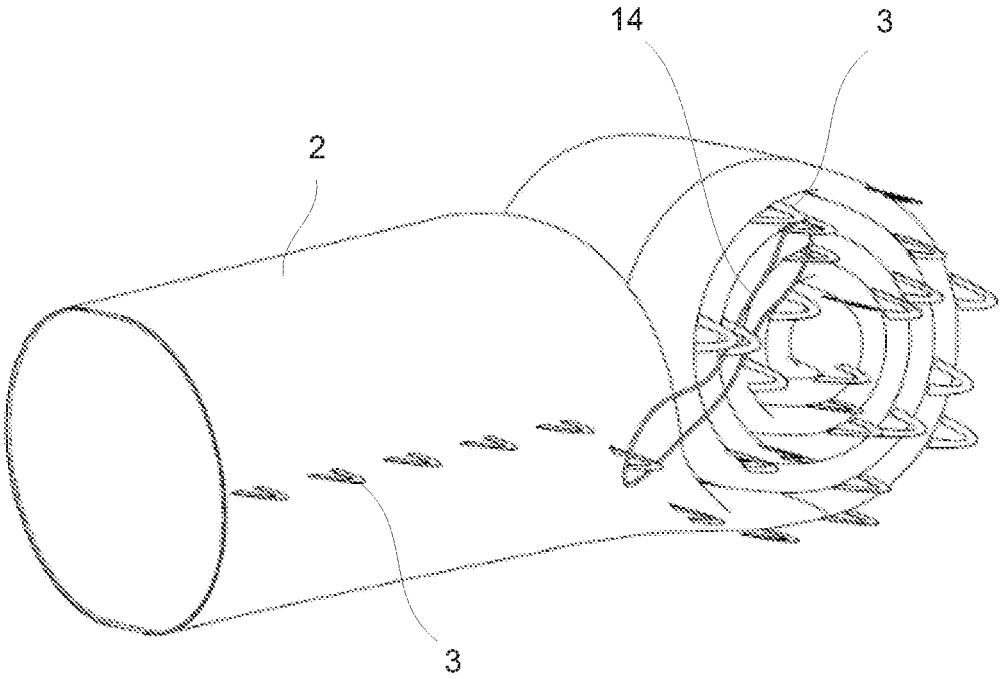
FIG. 6*b* shows the flexible tube of a system according to the invention provided in a rolled up/coiled condition using the position means.

In order to ensure that the flexible tubes 2 are deployed as desired, the position means 3 are in the embodiment shown in FIG. 6*b* used to maintain the flexible tube 2 in a rolled up position, by connecting a number of position means 3 on the same tube using a fastening means 14, and then gradually releasing the tube 2 during deployment by releasing the position means 3 one at a time. In this way, the uncoiling of the flexible tube 2 can be decelerated and/or stopped during deployment, such that the tube easily can be placed in a desired e.g. curved position such that any obstacles etc. easily can be avoided. Said tube can then be filled with liquid as described as for FIG. 7 etc.

Figure 7:
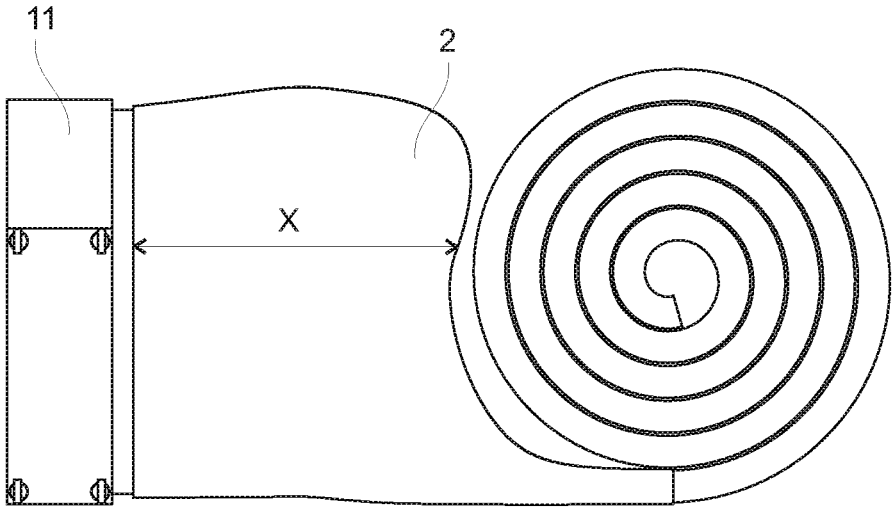
FIG. 7 shows how the flexible tube of FIG. 6*a* is unrolled as liquid is added to the tube.
Figure 8:
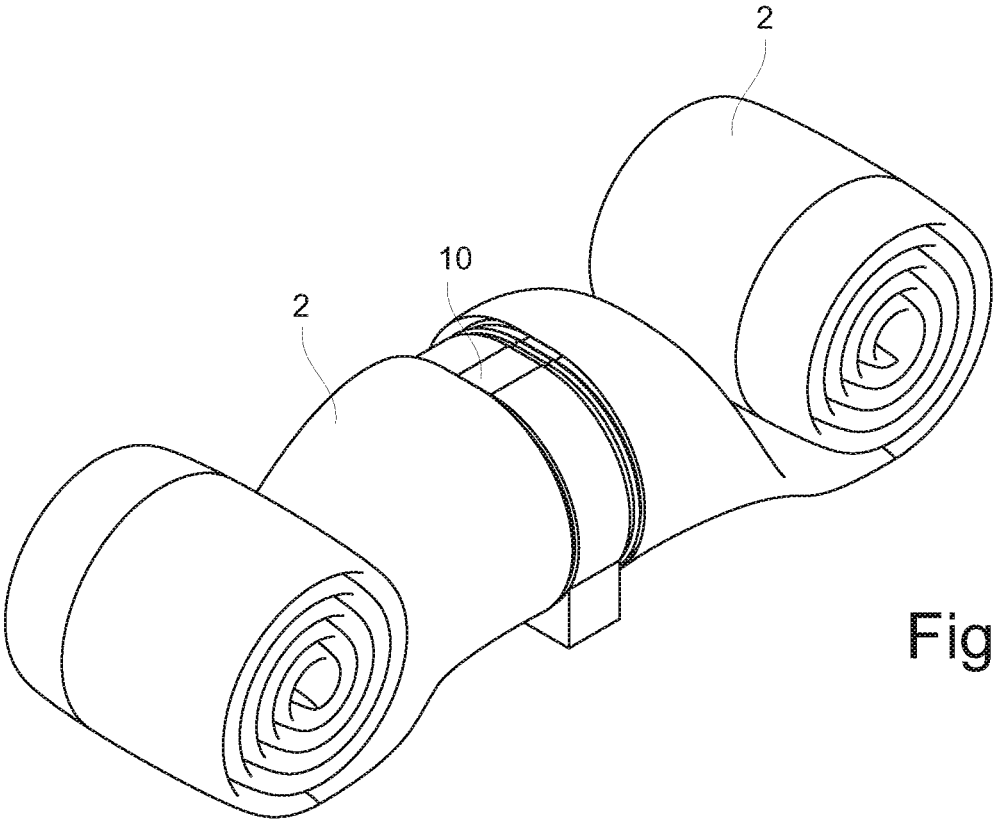
FIG. 8 shows a further embodiment of the system according to the invention, in which one coupling unit is connected to two flexible tubes.

FIG. 8 shows a further embodiment of the system according to the invention, in which one coupling unit 10 is connected to two flexible tubes 2, each provided in a coiled condition, such that said tubes can be unrolled in opposite directions when liquid is added to the tubes, in a similar manner as shown for one tube in FIG. 7.

Figure 9:
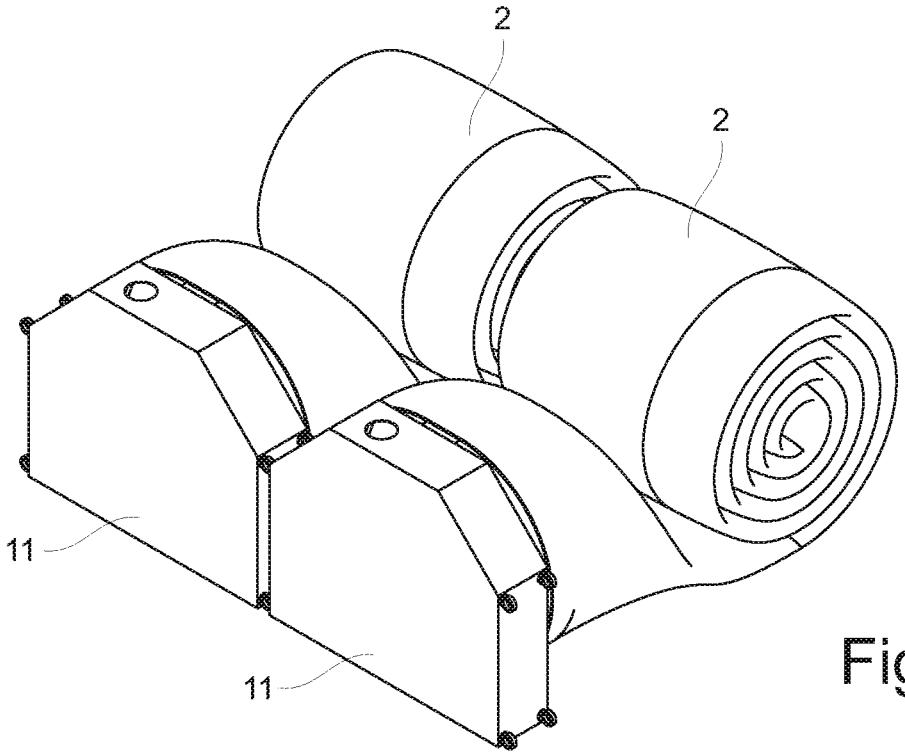
FIG. 9 shows a further embodiment of the system according to the invention, in which two flexible tubes are unrolled simultaneously side by side.
Figure 10:
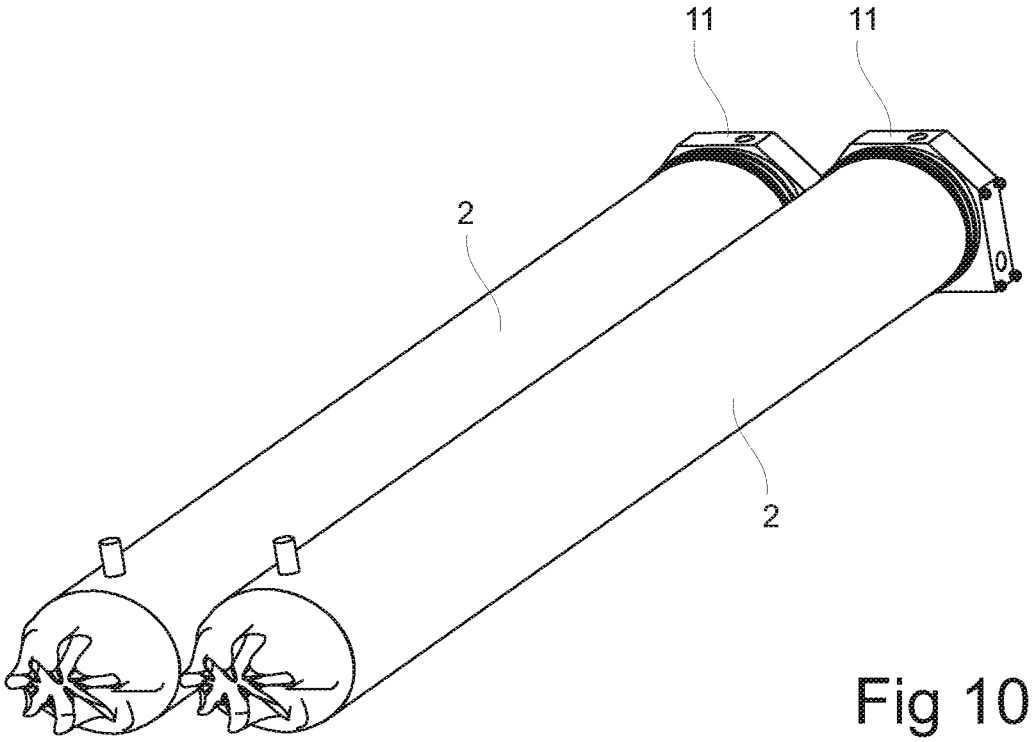
FIG. 10 shows a further embodiment of the system in which the two flexible tubes shown in FIG. 9 have been unrolled.

Two, or more, flexible tubes can also be unrolled simultaneously side by side, as shown in FIG. 9, providing an unrolled construction, corresponding to the construction of FIG. 10. Additional tubes can be added in all directions, i.e. to vary the length, height, and breadth of the construction, using the position means, thereby providing a flood protecting system which is flexible, durable and effective.

When the tube is closed, as shown in FIG. 1, the loops 8 can be used a position means, mechanically connecting one tube with a second tube having similar loops, using a fastening means, such as a rope or wire.

A person skilled in the art will understand that the method according to the invention can be used for any kind of flexible tube 2, irrespectively of whether or not said tube comprise any position means. It is however preferred, that the method further comprises anchoring the at least one flexible tube to the underlying terrain/ground during the deployment, thereby ensuring that the tube cannot be displaced from the desired location, when exposed to external forces.

When the flood protection system according to the invention is no longer needed, liquid is evacuated through the outlet 12. Where the fill material is water, it will often be possible to simple pour it out in the area where the flood protection system was used, with the water being soaked into the ground, evaporating, or entering a nearby body of water. When the at least one flexible tube is empty, it can be rolled (folded up) for storage purposes, to provide a structure as shown for example in FIGS. 6*a* and 6*b*.

Integrating the system according to the invention into the existing flood protection may significantly improve the effectiveness of the work of the rescue units and thus minimize casualties as well as damage to properties.

A person skilled in the art will understand that the system according to the invention, can be quickly and easily erected with minimal effort and can not only be used for forming a flood barrier but also for other purposes such as protecting a limited area from hazardous spillage, and for erecting a children's paddling pool without departing from the scope of this invention.

Modifications and combinations of the above principles and designs are foreseen within the scope of the present invention.

What is claimed is:

1. A flood protection system comprising at least one elongated flexible tube arranged for containing a liquid, wherein the at least one elongated flexible tube comprises a number of position means, wherein at least two position means placed at different positions on the same elongated flexible tube are connected along a side of the same elongated flexible tube by fastening means, and wherein the same elongated flexible tube is placed in a desired position selected from the group consisting of a coiled position, a curved position, a U-shaped position, and a S-shaped position.

2. A flood protection system according to claim 1, wherein the desired position of the at least one elongated flexible tube is a curved position.

3. A flood protection system according to claim 1, wherein the position means is arranged for anchoring the at least one elongated flexible tube to the underlying terrain/ground.

4. A flood protection system according to claim 1, comprising at least two or more elongated flexible tubes, wherein the position means is arranged for connecting a number of adjacent elongated flexible tubes.

5. A flood protection system according to claim 1, wherein the position means comprises positioning elements.

6. A flood protection system according to claim 5, wherein the positioning elements include a loop, an eyelet, a snap hook, a snap fit, a key-lock arrangement, or a hook-and-loop fastener.

7. A flood protection system according to claim 1, wherein the fastening means is further arranged either for connecting at least two position means on different elongated flexible tubes, or for together with the position means anchoring the elongated flexible tube to the ground, or for both functions.

8. A flood protection system according to claim 1, wherein the at least one elongated flexible tube comprises a number of identical or different position means.

9. A flood protection system according to claim 1, wherein a number of position means are placed in one or more rows on the outer surface of the at least one elongated flexible tube and substantially along the complete length of the at least one elongated flexible tube.

10. A flood protection system according to claim 1, wherein the system comprises at least two elongated flexible tubes, and further comprises at least one coupling unit arranged for interconnecting at least two elongated flexible tubes.

11. A flood protection system according to claim 1, wherein the at least one elongated flexible tube comprises an outer layer arranged for providing mechanical strength to the at least one elongated flexible tube, and at least one inner layer, arranged for providing impermeability from liquids.

12. A flood protection system according to claim 1, comprising one or more weight-addition units associated with or disposed inside the at least one elongated flexible tube.

13. A method of using a flood protection system, thereby providing flood protection which comprises the steps of:

providing at least one elongated flexible tube that comprises a number of position means, deploying the at least one elongated flexible tube simultaneously with filling of the same elongated flexible tube with a fluid, and connecting at least two position means on the same elongated flexible tube along a side of the same elongated flexible tube by fastening means, wherein at least two position means placed at different positions on the same elongated flexible tube are connected along a side of the same elongated flexible tube by fastening means, and wherein the same elongated flexible tube is placed in a desired position selected from the group consisting of a coiled position, a curved position, a U-shaped position, and a S-shaped position.

14. A method according to claim 13, wherein the fluid for filling the at least one elongated flexible tube is a liquid, air, or a combination of liquid and air including air followed by liquid.

15. A method according to claim 13, wherein the method further comprises anchoring the at least one elongated flexible tube to the underlying terrain/ground during the deployment.

16. A method according to claim 13, wherein the at least one elongated flexible tube is coiled for storage and transport and uncoiled when the tube is to be deployed.

17. A method according to claim 16, wherein a number of position means are connected when the at least one elongated flexible tube is placed in the coiled position, and wherein the method further comprises gradually releasing the at least one elongated flexible tube during deployment by releasing the position means one at a time.

18. A method according to claim 13, wherein at least two adjacent elongated flexible tubes are connected using the position means.

19. A flood protection system comprising at least one elongated flexible tube arranged for containing a liquid, wherein the at least one elongated flexible tube comprises a number of position means, wherein the same elongated flexible tube is placed in a desired position obtained by connecting at least two position means placed at different positions on the same elongated flexible tube along a side of the same elongated flexible tube by fastening means, and wherein the desired position of the same elongated flexible tube is selected from the group consisting of a coiled position, a curved position, a U-shaped position, and a S-shaped position.

* * * * *